United States Patent [19]

McCue

[11] 4,232,248

[45] Nov. 4, 1980

[54] INTERNAL METAL STRIPE ON CONDUCTIVE LAYER

[75] Inventor: Bernard B. McCue, Christian Island, Canada

[73] Assignee: RCA Corporation, New York, N.Y.

[21] Appl. No.: 955,627

[22] Filed: Oct. 30, 1978

[51] Int. Cl.[3] ..... H01J 29/18

[52] U.S. Cl. ..... 313/479

[58] Field of Search ..... 313/479, 450

[56] References Cited

U.S. PATENT DOCUMENTS

| | | | |
|---|---|---|---|
| 2,820,166 | 1/1958 | Pinotti | 313/318 |
| 3,562,004 | 2/1971 | Myers | 313/479 X |
| 3,621,318 | 11/1971 | Lewinson | 313/479 |
| 3,802,757 | 4/1974 | Benda et al. | 313/479 |
| 4,101,803 | 7/1978 | Retsky et al. | 313/477 R |

FOREIGN PATENT DOCUMENTS

| | | | |
|---|---|---|---|
| 47-27489 | 8/1972 | Japan | 313/479 |

*Primary Examiner*—Robert Segal

*Attorney, Agent, or Firm*—E. M. Whitacre; G. H. Bruestle; L. Greenspan

[57] ABSTRACT

In a cathode-ray tube wherein the electrical connection between a conductive metal body attached to and having a surface contiguous with a surface of the envelope and a conductive layer on that surface is assured by a conductive stripe contacting the body and the layer, the stripe consists essentially of a minor proportion of glass and a major proportion of at least one metal selected from the group consisting of tin, lead and indium.

3 Claims, 3 Drawing Figures

Fig. 1.
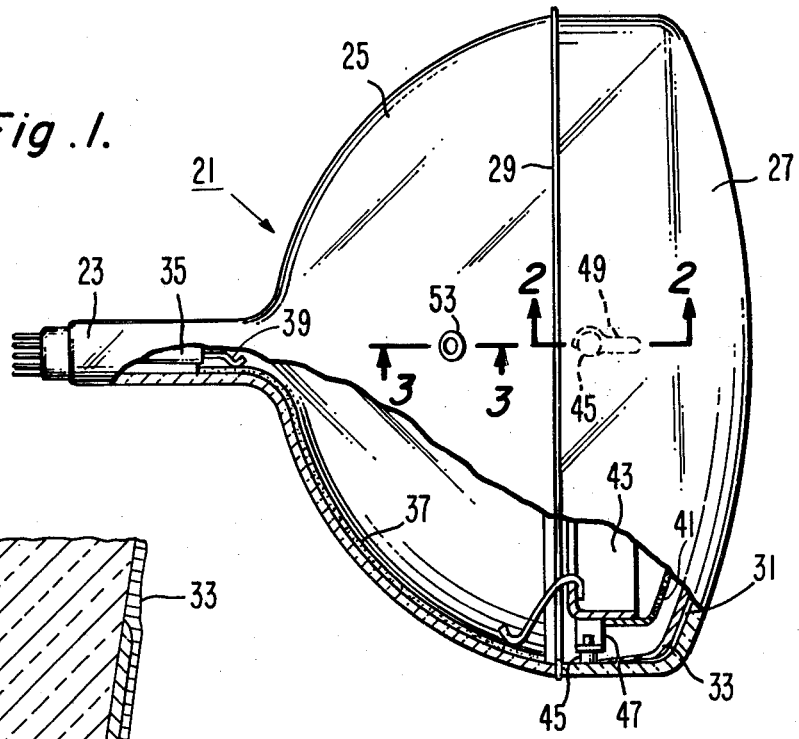
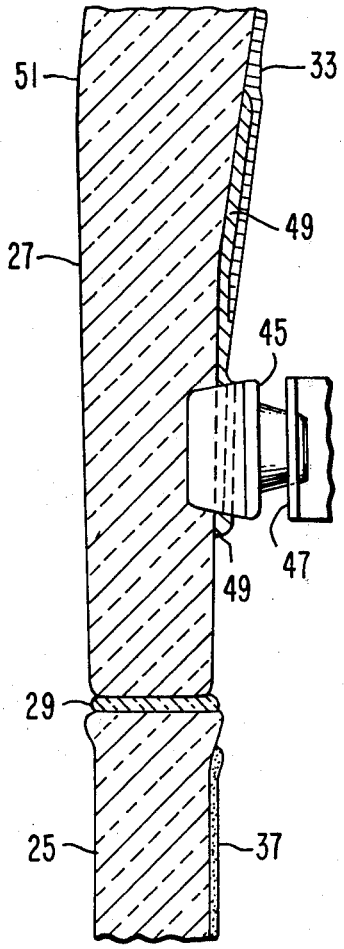
Fig. 2
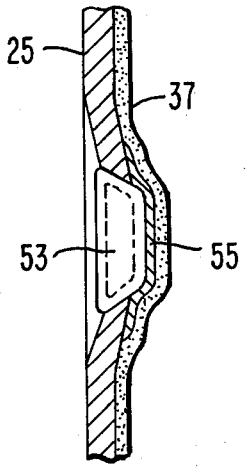
Fig. 3.

INTERNAL METAL STRIPE ON CONDUCTIVE LAYER

BACKGROUND OF THE INVENTION

This invention relates to a novel CRT (cathode-ray tube) and particularly to a CRT having an internal electrically-conductive stripe or patch and to a method for preparing that CRT.

A CRT usually includes an evacuated glass envelope, an electrically-conductive funnel coating or layer on the inside wall of the envelope and a metal anode button sealed through the wall of the envelope and in electrical contact with the funnel coating. The funnel coating is used to carry a high potential that is applied at the anode button. Some CRT types include a metallized luminescent viewing screen supported on the inner surface of the faceplate of the envelope, and an apertured mask assembly closely spaced from the viewing screen and supported on several metal studs imbedded in the wall of the envelope.

The proper operation of the CRT requires that there be electrical continuity between the viewing screen and the anode button. When there is a discontinuity, electrical charges build up on the screen causing erratic operation of the CRT. Usually the break in continuity is found on the inside surface of the envelope adjacent the studs or the anode button. In order to insure electrical continuity, it has been the practice to apply an electrically-conductive coating in the form of a stripe or patch to at least one of the studs and/or the anode button. This has been done by brush painting or otherwise coating a stripe or patch of a composition which, after drying and heating, to about 400° C., forms a chemically-stable, electrically-conductive stripe or patch across the area of interest. Most prior stripes or patches consist essentially of graphite with an alkali silicate binder, similar in character to the funnel coating. Such prior coating compositions have several disadvantages for these applications. They are relatively slow to dry. After they dry, they are not sufficiently insoluble in water to withstand subsequent processing with aqueous media.

SUMMARY OF THE INVENTION

As in the prior art, the novel CRT comprises an evacuated glass envelope, a conductive metal body attached to the interior envelope surface, and a conductive layer adhered to at least a portion of said interior surface. In the novel CRT, a conductive coating in the form of a stripe or patch contacts both the conductive layer and the metal body. The conductive coating consists essentially of a major proportion of at least one metal selected from the group consisting of tin, lead, and indium, and a minor proportion of a glass; preferably about 2 to 5 weight percent of a devitrified glass.

In the novel method, the conductive coating is made by applying, preferably by brushing, a stripe comprising a mixture of metal particles or flakes, glass particles and an organic polymeric binder in an organic solvent upon the desired surface. Then, the structure including the conductive coating is heated until the organic material in the stripe is removed and the metal and glass particles are sintered or melted together. In a preferred embodiment, a stud and adjacent faceplate are coated and then the screen is filmed, metallized and baked in the usual manner. The coating can be applied when the faceplate is on a screening machine just before the filming step because of its rapid drying qualities. Filming and metallizing can be done on top of the stripe because of its good mechanical strength and insolubility in water. After baking, the coating has good mechanical strength and good electrical conductivity.

BRIEF DESCRIPTION OF THE DRAWINGS

FIG. 1 is a partially broken away longitudinal view of a novel CRT of the invention.

FIG. 2 is an enlarged fragment of the envelope of the tube shown in FIG. 1 along section line 2—2.

FIG. 3 is an enlarged fragment of the envelope of the tube shown in FIG. 1 along section line 3—3.

DETAILED DESCRIPTION OF THE PREFERRED EMBODIMENT

The CRT illustrated in FIG. 1 is an apertured mask type kinescope. The CRT includes an evacuated envelope designated generally by the numeral 21, which includes a neck 23 integral with a funnel 25 and a faceplate or panel 27 joined to the funnel by a seal 29, preferably of devitrified glass. There is a mosaic luminescent layer 31 comprised of different-color-emitting phosphor materials on the interior surface of the faceplate 27. There is a light-reflecting metal layer 33, as of aluminum, on the luminescent layer 31. The luminescent layer 31, when suitably scanned by three electron beams from a gun in a mount assembly 35 located in the neck 23, is capable of producing a luminescent image in color, which may be viewed through the faceplate 27. The luminescent layer 31, the light-reflecting metal layer 33 and any associated structure constitute the viewing screen of the tube.

There is an electrically-conducting internal funnel coating 37 on a portion of the interior surface of the funnel 25 between the mount assembly 35 and the seal 29. Three metal fingers 39 space the mount assembly 35 from the neck wall and connect the forward portion of the mount assembly 35 with the funnel coating 37. Closely spaced from the metal layer 33 toward the mount assembly 35 is a metal mask 41 having a multiplicity of apertures therein. The mask 41 is welded to a metal frame 43 which is supported by springs 47, which are attached to the frame 43, on studs 45 sealed in the wall of the panel 27. Except for the features now to be discussed, the tube is conventional in construction and operation, so that a more detailed description thereof is not necessary.

FIG. 2 shows a stud 45 and the adjacent structure in more detail. The stud 45 is imbedded in the inner side wall of the panel 27 and an electrically-conducting coating in the form of a stripe or patch 49 according to the invention is supported on the inner surface of the panel 27 and extends into contact half way around the stud 45 and then toward the luminescent layer 31 as far as about the mold match line 51. The metal layer 33 extends from over the luminescent layer 31 toward the stud 45 overlapping and in contact with the stripe 49. The stripe 49 may be in other orientations if desired. The stripe 49 is constituted of about 96 weight percent tin metal and about 4 weight percent devitrified glass.

This preferred conductive coating may be prepared by the following procedure. The luminescent layer 31 is deposited on the faceplate 27 by any of the known prior methods. Then, after screening is complete and prior to filming the luminescent layer 31, a coating in the form of a stripe is applied with a brush to the inner surface of the panel 27 contacting one stud 45 and to where the metal layer 33 will be. A suitable striping composition is prepared by milling 96 grams of tin metal powder with 25 grams of a 3 weight percent solution of ethyl cellulose in xylene for about 18 hours using ¼" steel balls. Then, 4 grams of solder glass powder of the type used to make the seal 29 are added to the mill and the milling is continued for about 6 hours. The milled slurry is removed from the mill and is ready for use in the novel method. After application, the stripe dries rapidly into a water-insoluble material that may be subjected to water-based treatments, such as filming with a water-based emulsion and rinsing with water. The luminescent layer 31 is now filmed with an organic polymeric film as desired and dried. Then, the panel is metallized by vaporizing aluminum metal from an evaporator at a reduced pressure (about $10^{-3}$ torr) and intercepting the vapor on the filmed luminescent layer 31, the stripe 49 and the stud 45. Because of the paths taken by aluminum metal vapor from the evaporator, there is always an area around the base of the stud 45 where aluminum is not deposited or the aluminum layer is too thin to provide adequate electrical conductivity. The stripe 49 extends and distributes the contact area with the metal layer 33. Following the metallizing step, the panel 27 is baked in air in a lehr during which time the volatile and organic matter in the luminescent layer 31, the filming, and the stripe 49 are volatilized and thereby removed. The lehr reaches a maximum temperature of about 450° C. During this baking step the tin and glass of the stripe flow into a uniform layer. The solder glass powder also melts and after cooling bonds the tin layer firmly into the panel glass surface and the metal body. The resultant conductive coating has a resistivity of about 1 to 5 ohms per linear inch. After the baking step, the panel is sealed to the funnel 25 with a devitrified glass seal 29 and subsequent tube assembly steps are carried out to complete an evacuated CRT by methods described previously in the prior art.

As shown in FIGS. 1 and 3, an anode button 53 may be stripped by the novel method. The anode button 53 is a metal body sealed into the wall of the funnel with a surface contiguous with the inner surface of the funnel 25. Ordinarily the funnel coating 37 extends over both surfaces. Sometimes the coating 37 cracks around the button 53 giving an electrical discontinuity. The problem can be overcome by applying a stripe or patch 55 to these contiguous surfaces according to the novel method. As shown in FIG. 3, the stripe 55 is between the button 53 and the coating 37. The stripe produced according to the novel method may be applied by brush or spray.

The preferred conductive stripe is prepared from a slurry containing tin metal flakes, organic and inorganic binders in an organic solvent, such as xylene. Tin powder and solder glass powder, which is the inorganic binder in the ultimate stripe, are premixed so that the solder glass is present at a concentration of 2 to 5 weight percent relative to the tin powder and glass. Three to four parts of this mixture are slurried with one part of a 3 to 5 percent solution of ethyl cellulose in xylene and then ball milled for 24 hours. Ball milling reduces the particles of tin to flakes, which results in greater conductivity in the ultimate stripe due to the greater area of contact of the flakes. A further result of milling is that the milled slurry stays in suspension longer because of the higher surface-area-to-weight ratio of the tin metal flakes than metal particles that have not been milled. The milled slurry is applied by brush or spray gun on the panel or funnel side wall and touching the stud or anode button as the case may be. As the screen panel or funnel is further processed, the organic binder, the ethyl cellulose, serves to keep the coating intact until the screen panel or funnel reaches the high-temperature baking, where all the organics are removed from the screen or funnel. At this point, the tin becomes molten and flows to a uniform layer. The solder glass powder also melts and devitrifies and serves to bond the conductive stripe of the tin metal firmly to the glass surface.

In making a CRT, the phosphors are fixed in a regular array of dots or stripes to the panel and the panel is dried. It is at this point when it is most desirable to coat the panel sidewall up to the stud with a conductive material because the side walls are clean and dry. The filming operation which follows employs binders and filming materials in aqueous solutions. It is therefore necessary to formulate a striping composition which, when coated and dried, is hydrophobic so that the applied conductive coating will not wash off or be leached during subsequent steps, such as emulsion filming, which employ an aqueous medium.

Tin powder with a particle size of about 300–400 mesh and solder glass are ball milled in an ethyl cellulose-xylene solution for about 24 hours using ¼ to ⅜ inch steel balls. It is an essential part of the novel method to employ particles of a metal or alloy which is malleable and ductile, which possesses a melting point of lower than about 400° C. and a boiling point higher than about 1500° C. Tin, lead and indium or any combination of these metals are suitable. Tin becomes molten during the bakeout of the organic materials from the screen panel. The bakeout of the organics is done in a lehr, which obtains a maximum temperature of about 450° C. during the baking cycle. At about 230° C., tin melts to form a layer of conductive metal. Solder glass powder begins to melt at about 380° C. and after cooling bonds the layer of tin firmly onto the glass surface. The solder glass powder is the inorganic binder used in this method. The organic binder has to be an organic polymer dissolved in an organic solvent. The organic binder should make the applied stripe hydrophobic and provide adherence during the filming and subsequent screen-making processes. Some suitable organic binders are ethyl cellulose and ethyl acetate. They are soluble in various organic solvents which have a range of boiling points from 75° C. to 140° C. Some solvents which may be used are xylene, propyl acetate, butyl acetate, amyl acetate, ethyl cellosolve, methyl cellosolve and ethyl benzene.

Ethyl cellulose and cellulose acetate are preferred organic binders because they are hydrophobic, they have good binding properties, and they are not inflammable materials. They decompose rather than ignite at high temepratures, such as those experienced in the baking lehr. Nitrocellulose was found to be unsuitable because it ignites explosively at these temperatures and removes the thin layer of aluminum which is applied over the stripe. Xylene was found to be an excellent solvent because it evaporates rapidly from the surface of the coating and forms a hydrophoric surface, but does not evaporate so fast that it forms a crust around the brush applicator between applications.

I claim:

1. A cathode-ray tube comprising an evacuated glass envelope including a funnel, a neck integral with said funnel, a faceplate sealed to said funnel, and a luminescent layer on the interior surface of said faceplate, a conductive layer adhered to at least a portion of the interior surface of said envelope, a conductive metal body attached to said interior envelope surface, and a conductive coating contacting both said layer and said metal body, said conductive coating consisting essentially of tin metal and about 2 to 5 weight percent of denitrified glass.

2. The cathode-ray tube defined in claim 1 wherein said metal body is a stud sealed into said envelope, and a conductive layer is said specular metal layer over said luminescent layer.

3. The cathode-ray tube defined in claim 1 wherein said metal body is an anode button sealed into said funnel, and said conductive layer comprises a layer comprising graphite particles on the inner surface of said funnel.

* * * * *

UNITED STATES PATENT AND TRADEMARK OFFICE
CERTIFICATE OF CORRECTION

PATENT NO. : 4,232,248

DATED : November 4, 1980

INVENTOR(S) : Bernard Beverly McCue

It is certified that error appears in the above-identified patent and that said Letters Patent is hereby corrected as shown below:

Column 3, line 41 change "stripped" to --striped--

Column 5, last line change "denitrified" to --devitrified--

Signed and Sealed this

*Seventeenth* Day of *March 1981*

[SEAL]

*Attest:*

RENE D. TEGTMEYER

*Attesting Officer* *Acting Commissioner of Patents and Trademarks*